United States Patent [19]

DeLacy et al.

[11] Patent Number: 4,625,872

[45] Date of Patent: Dec. 2, 1986

[54] METHOD AND APPARATUS FOR PARTICLE SORTING BY VIBRATION ANALYSIS

[75] Inventors: Thomas J. DeLacy, Los Altos; John R. Bingham, Stockton; George F. Carroll, Manteca, all of Calif.

[73] Assignee: Diamond Walnut Growers, Stockton, Calif.

[21] Appl. No.: 649,257

[22] Filed: Sep. 10, 1984

[51] Int. Cl.[1] ..... B07C 5/34

[52] U.S. Cl. ..... 209/557; 209/599; 209/631; 209/639

[58] Field of Search ..... 209/555, 557, 558, 590, 209/599, 631, 637–640, 699; 73/79, 432 PS, 573; 364/508

[56] References Cited

U.S. PATENT DOCUMENTS

| | | | |
|---|---|---|---|
| 3,127,016 | 3/1964 | Baigent | 209/599 X |
| 3,559,805 | 2/1971 | Cragg et al. | 209/599 X |
| 3,788,466 | 1/1974 | Wilson et al. | 209/599 |
| 4,082,655 | 4/1978 | Toledo | 209/173 |
| 4,147,620 | 4/1979 | Artiano et al. | 209/590 |
| 4,208,915 | 6/1980 | Edwards | 73/620 |
| 4,212,398 | 7/1980 | Parker et al. | 209/590 |
| 4,352,431 | 10/1982 | Artiano | 209/600 |
| 4,375,853 | 3/1983 | Feller et al. | 209/640 |

FOREIGN PATENT DOCUMENTS

| | | | |
|---|---|---|---|
| 54-73362 | 6/1979 | Japan | 209/640 |
| 0156043 | 7/1932 | Switzerland | 209/640 |

*Primary Examiner*—Robert B. Reeves
*Assistant Examiner*—Edward M. Wacyra
*Attorney, Agent, or Firm*—Townsend and Townsend

[57] ABSTRACT

A novel particle sorting system based on vibrations induced by impact against a strike plate is disclosed, wherein two strike plates in succession are used, the first to absorb kinetic energy from certain particles on a preferential basis due to particle composition, and the second to absorb the residual kinetic energy for analysis. Vibrations arising in the second strike plate due to particle impact which meet preset criteria corresponding to undesired particles are used to actuate an ejection system which sends an impulse to the offending particle, deflecting it from its otherwise undisturbed trajectory. Also disclosed is an analyzing circuit which combines two or more waveform features of the vibration signal in an algorithm such as a ratio, to provide an unusually high sensitivity for discrimination among the particles. In addition, the need to form a single file of particles before they can be put through the system is avoided by the use of a curved surface to convert the particle mixture to a free-falling monolayer, and by sensing impacts of the second strike plate in a region-specific manner.

46 Claims, 4 Drawing Figures

METHOD AND APPARATUS FOR PARTICLE SORTING BY VIBRATION ANALYSIS

BACKGROUND OF THE INVENTION

1. Field of the Invention

The present invention relates to the sorting of particle mixtures according to particle composition. In particular, this invention relates to the use of vibrational analysis to differentiate among particles of varying composition. The term "particle" is used throughout this specification to denote any single discrete element in a mixture, regardless of size.

2. Description of the Prior Art

Vibrational analysis is known to be useful for the rapid automated sorting of particles in a moving stream. Systems utilizing this technique generally involve directing a stream of particles, one at a time, against a strike plate, and analyzing the mechanical vibrations occurring in the strike plate as a result of the impact. Differences in one or more characteristics of the vibrations are then related to differences in the particle size or composition. The deflection of certain particles from the stream on the basis of these vibrational characteristics is then done by automatic signal processing.

A wide range of particle properties can be used as a basis for the differentiation. Examples are hardness, density and elasticity. Deflection to isolate the unwanted particle may be achieved by mechanical, pneumatic, magnetic or electrical means, depending on the nature of the particle.

The concept of sorting through vibration analysis has been applied to a wide variety of mixtures ranging from pulverized refuse to bulk food, and it is conceivably applicable to particles ranging in size from granular to relatively large dimensions. The technique is useful for either sorting particles into portions having certain properties in preselected ranges, or for checking for and removing substandard units from a production line. The food nut industry has disclosed the technique as potentially useful for separating nutmeats from shell fragments after the whole nuts have been cracked and broken into pieces. See for instance, Parker et al., U.S. Pat. No. 4,212,398, July 15, 1980. Limitations of throughput, range and sensitivity, however, have shown the technique to be impractical for on-line sorting in the walnut industry.

All of the various systems developed to date employ a single impact plate. Vibrations resulting from the impacts in such systems have multiple frequency components, and different types of particles tend to overlap substantially in their range of response. The overlap makes selection difficult and creates a high degree of inaccuracy. A further problem with existing systems is the need for separating the particles into a single file stream aimed at the strike plate so that the impacts can be analyzed individually. This either slows down the process considerably or, if a large number of parallel analyzers is used, requires sufficient equipment to break the flow into an equal number of single file streams. Finally, single file sorting often requires that the particles be accelerated. This causes product damage and increases the amount of waste produced.

SUMMARY OF THE INVENTION

A novel particle sorting system is provided herein which has significantly improved sensitivity over its predecessors in the prior art. The system employs two strike plates arranged for successive impact by the particle stream, the first absorbing kinetic energy from certain particles on a preferential basis due to the particle composition, and the second absorbing the remaining kinetic energy for purposes of analysis and discrimination.

It has been discovered that for a given number of particles, a system of this description reduces the number of impacts which generate vibrational signals within the response range designated for deflection. Accordingly the system provides an unusually clean separation of particles according to composition. In addition, the number of events to be analyzed (i.e., signals above the noise threshold) is significantly reduced, thereby increasing the capacity of the system in terms of particle volume, permitting higher throughput rates. A further benefit is that the energy differences at the second strike plate correlate more closely to particle composition rather than to size. Consequently, the system, unlike its single impact predecessors, can accommodate particle mixtures with a wide size distribution, without substantial loss of discrimination capability.

Further provided herein is a system which substitutes a continuous free-falling monolayer of particles for individual single file streams, thus avoiding the slowness of feeding particles one at a time and the need for equipment components which are capable of forming the particles into single file streams.

DESCRIPTION OF THE PREFERRED EMBODIMENTS

Figure 1:
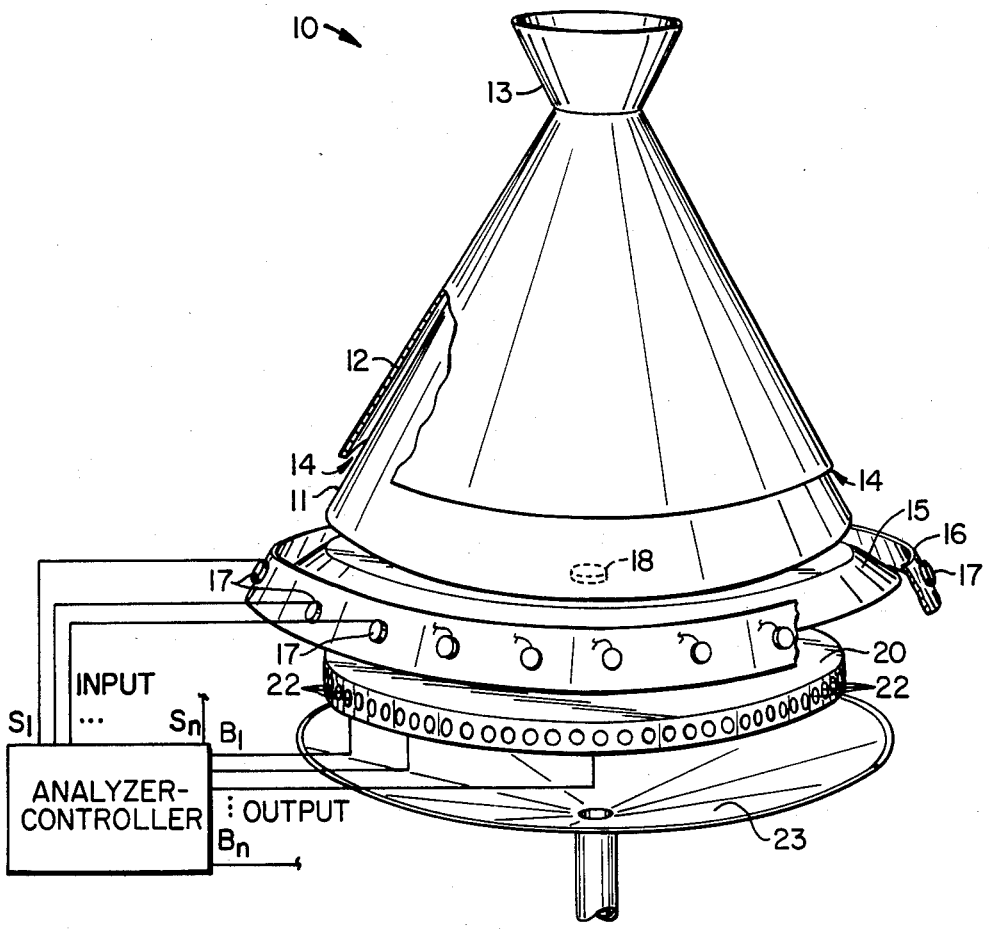
FIG. 1 is a perspective view of an illustrative apparatus embodying the apparatus and method of the present invention.

An example of a sorting device in accordance with the present invention is illustrated in the first two drawings, which depict an apparatus 10 for separating a mixture of particles into two streams.

The upper portion of the apparatus, comprised of a cone 11 and a conical shell 12, functions as both a guide for propelling or giving motion to the particles in a specified direction and a homogenizer for equalizing the particle speeds. Indeed, the cone and shell as shown produce a continuous series of essentially parallel trajectories defining a falling monolayer, i.e., a moving layer of particles, preferably not touching one another, the layer being at most approximately one particle deep. Equivalent results may be obtained using sloping surfaces of a wide variety of curvatures and shapes, as well as funnel or trough-type arrangements with elongated openings, vibrating surfaces, rolling cylinders and the like. The exact method of creating the trajectory is not critical, provided only that the trajectory is substantially well-defined (and thus at a fixed speed). A free-falling monolayer is preferred.

In the embodiment shown in the drawings, the particle mixture is fed into a hopper 13 located at the vertex of the dispersing cone 11. The particles then flow downward under the influence of gravitational force through the gap 14 between the cone surface and the shell 12. The angle of the cone and shell and the width of the gap are selected such that a sufficient number of collisions occur between the particles and the cone surfaces to remove any kinetic energy the particles may have had before entering the hopper. The resulting particle speed at the gap exit will then be essentially only that resulting from the influence of gravitational force on the particle while in the gap. The angle, curvature and length of the cone further serve to spread the particles apart so that a monolayer of discrete, non-touching particles results. With these considerations in mind, the cone dimensions and gap width may vary widely, provided only that substantially all of the particles emerging from the gap at the bottom of the shell are falling downward at approximately the angle of the cone and at approximately the same speed. The arrangement thus acts to render uniform the particle speeds and directions. Of course, the speeds will vary somewhat with the mass and shape of the particles due to the effect of air and surface resistance on free flow.

While the gap width is not critical, best results will be achieved in most applications by using gap widths ranging from about 1.5 to about 10 times the major dimension of the largest particle in the mixture, preferably from about 2 to about 5 times. The angle of the delivery cone may also vary widely, although it will affect the ultimate particle speed. For particles such as walnut pieces of up to about 5/16-inch (0.8 cm) diameter, best results will be achieved at delivery cone angles between about 30° and about 80°, preferably from about 45° to about 75°, measured with respect to the horizontal. Finally, preferred cones are those whose outer surface length from base to vertex ranges from about 5 to about 50 times the width of the gap.

A first impact surface 15 is positioned to intersect the entire monolayer, and to rebound the falling particles along a second trajectory or monolayer at an angle to the first. The intersection between the first monolayer and the impact surface 15 is generally a line, preferably horizontal, although the surface itself may be either horizontal or angled as shown. An angled surface is generally preferred for purposes of controlling the flow path of the particles through the apparatus, as well as for maintaining a substantial linear momentum in each particle throughout the remainder of the collision path. Angled surfaces also serve to prevent particles from coming to rest on the surface. Thus, for a circular system as shown, the first impact surface preferably assumes the form of a transverse conical section coaxial with the delivery cones 11 and 12, but with an angle, measured with respect to the horizontal, less than that of the delivery cones. Again, the angle is not critical and can vary widely, provided only that it provides a particle flow path bearing the considerations enumerated above. An angle ranging from about 30° to about 50° with respect to the horizontal has been found to provide particularly favorable results in the case of walnut pieces, and will extend to similar particle mixtures as well. The optimum angle will of course depend on the angle of the delivery cones.

The impact surface will generally be a rigid plate of sufficient stiffness to cause the particles to bounce off as a result of the impact and be able to absorb kinetic energy in preferential manner from certain particles in the mixture on the basis of their composition. In particular, it has been found that particles rebounding from a surface will transfer varying amounts of their kinetic energy to the surface during the impact due to differences in their compositions and physical characteristics. Nutmeats, for example, tend to lose more energy through the initial strike plate impact than do shell fragments. While the exact mechanism by which this occurs has not been established, it may be attributable to oil content, deformability, or a combination of features influencing the degree of acoustic coupling and scattering by the particle.

In preferred embodiments, the first strike plate is also capable of self-supported free vibration as a result of the impact. This permits the response in the plate itself to be sensed and analyzed as part of the overall sorting procedure, thus adding versatility to the device or providing a coarse rejection feature in addition to the relatively sensitive discriminations provided by sensors directed at downstream collisions, as described below.

The second impact surface 16 is positioned to intersect the second trajectory or the entire second monolayer to rebound the particles along a third trajectory or monolayer which is at an angle to the second. The second impact surface functions to acquire vibrations as a result of the impact and to pass these vibrations on to detectors and an analyzing circuit. The surface further serves to direct particles by rebound into the path of a deflecting device which upon appropriate signal will send an impulse to particles in its path to deflect them from the remaining particles.

The location of impact on the second surface will approximate a line, preferably horizontal. Depending on the angle of the first surface, however, the trajectories rebounding from the first strike plate will vary depending on how much kinetic energy has been lost to the first strike plate. The trajectories will also vary with the size or mass of each particle and its air resistance during flight. Thus, the location of impact will generally be a horizontal band rather than a well-defined line, and the second impact surface will be sized sufficiently to intersect substantially the entire band.

With these considerations in mind, the exact location of the second impact surface and its angle with respect to the horizontal are not critical. In general, they will be selected in accordance with the position and orientation of the other components of the system. In the embodiment shown in the drawings, the surface is angled to rebound the particles downward to facilitate the collection of non-deflected particles in a narrowly defined region. Again, for a circular system as shown, the second impact surface, like the first impact surface, is a transverse section of a vertical cone coaxial with the delivery cones 11 and 12. Here, however, the impact surface is the inner surface of such a cone and it encircles the base of the first strike plate. The impact line on the second strike plate, or the center of the impact band if a well-defined impact line is lacking, is preferably located at approximately the midline of the surface.

In accordance with the preferred embodiments described above, the rebound distance and the angle of impact on the second strike plate with respect to the horizontal are all preferably constant over all of the trajectories in the monolayer, i.e., over the entire length of the impact line. The rebound distance, i.e., the distance in a given particle trajectory between its point of impact on the first strike plate and that on the second, may also vary widely, provided that it intersects all such trajectories yet leaves sufficient clearance for all particles to pass through the remainder of the system without further collisions. With these considerations in mind, the rebound distance may vary widely depending on the angles of the various cones, the rebound speeds of the particles, and the material, size and general nature of the particles. Using as examples the configuration shown in the drawings and a controlled size-range particle mixture comprised of unsorted shell and nutmeat pieces below about 5/16 inch (0.8 cm) maximum particle size, a rebound distance ranging from about 1 cm to about 20 cm will provide the best results.

The angle of the second rebound surface may also vary widely, provided only that it permits a sufficiently hard impact to acquire detectable vibrations, yet direct the second rebound path in an appropriate direction. Preferably, the angle, measured with respect to the horizontal, is greater than that of the first impact surface. For the configuration shown in the drawings, an angle ranging from about 60° to about 80° with respect to the horizontal will be particularly convenient.

The vibrations in the second strike plate are detected by a series of sensors, which may be any conventional devices capable of converting mechanical vibrations to an oscillating electrical signal, notably piezoelectric transducers. These are acoustically coupled to the rear of the plate along the line of impact, and are distributed so that all vibrations induced by impacts, regardless of the location of the impact, will be sensed. In preferred arrangements, the transducers are spaced far enough apart so that at most approximately two transducers will be within sensing range of any single impact. The number of transducers responding to a given impact may also be controlled by appropriately selected thresholds in the analyzer circuitry described below. Again, the spacing may vary widely depending on the dimensions of the device, as well as the particle composition and size and the expected range of variation in induced vibrations.

The transducer signals are analyzed on an individual basis, and the result is a localized response correlating the nature of the vibration arising from the impact of a certain particle to the location of impact. This permits the response to be directed at that particular particle without affecting other particles which are rebounding simultaneously.

As mentioned above, it is preferred that the vibrations induced in the first strike plate also be sensed for analysis, although using a coarser discrimination standard. This is particularly useful for the detection of foreign particles which occur in much lesser frequency than other substandard particles, and differing in gross manner therefrom in composition or nature. Examples of such foreign particles might be metal or glass pieces in a prescreened mixture of unsorted shell fragments and nutmeats.

The sensing device on the first strike plate may be a plurality of transducers with a localized response such as those on the second strike plate, or a single transducer 18 as shown in the drawings, responsive to vibrations occurring anywhere in the first strike plate. With a single transducer, an appropriate response would be momentary deflection of the entire monolayer. This will be sufficient when the occurrence of such a foreign object is very infrequent, such that there is no serious substantial loss of acceptable material overall, while lessening the danger of missing the object by a localized rejection impulse which is too narrowly directed.

The strike plate materials are preferably selected in accordance with their respective functions. The most important feature of the first strike plate, for instance, is that it tends to absorb more kinetic energy from certain impacting particles than from others based on differences in composition. The most important feature of the second strike plate, on the other hand, is that it absorb and transmit to the sensors a sufficient amount of the remaining kinetic energy to permit discrimination by signal analysis. Within these considerations, the appropriate choice will vary depending on the nature of the particle mixture.

For most applications, a first strike plate having moderate elasticity and dampening characteristics, in combination with a second strike plate having high elasticity and resilience will provide the best results. Strike plates to which sensors are attached are preferably manufactured from materials having small grain sizes and uniform grain boundaries to enable them to transmit mechanical wave signals to the transducers and yet impart sufficient rebound force to direct the particle along the desired trajectory. Further pertinent considerations include the impedance characteristics of the particle-to-plate interface upon impact (i.e., the degree of coupling) and the relative dampening characteristics of the various particle forms or compositions in the mixture. As mentioned above, the degree of energy transfer from particle to strike plate is highly dependent upon the configuration, deformability and composition of the particle. Accordingly, where discrimination is based on composition rather than size, the first and second strike plate materials may have the same or similar properties. In embodiments having sensors on both plates, it is preferred that each plate have both high elasticity and resiliency to produce a clean particle rebound with maximum signal transmission. Further considerations include formability and stress, as these may influence the performance of strike plates formed by machining. Furthermore, the thickness and shape of each plate may be varied to control the range and sensitivity of response.

The response of each strike plate is also controllable by selection of transducers and filters to provide an appropriate frequency range of response. A preferred range for response to low frequency acoustical or mechanical wave energy components is from about 75 kHz to about 200 kHz, whereas for high frequency acoustic or mechanical waves a range from about 500 kHz upward is preferred, with about 600 kHz to about 800 kHz particularly preferred. By the appropriate combination of the strike plate material and the transducer and filter response ranges, the entire range of vibrations is readily encompassed and both coarse and fine response can be achieved in a single system.

The transducer output signals are conveyed to an analyzer and control unit 19 which selects from the total those signals having certain characteristics as representing undesired particles. In particular, it has been discovered that by combining two or more waveform characteristics in a signal analysis algorithm, one can achieve a minimum of overlap between acceptable and unacceptable particles and consequently a particularly sensitive discrimination. By setting a minimum threshold level on the signals, one can utilize a variety of characteristic waveform features for incorporation into an algorithm. Examples of such features are the ring-down count (the number of threshold crossings resulting from a single impact), the event duration (the length of time over which threshold crossings from a single impact persist), the maximum peak amplitude, and the total energy absorbed by the strike plate from a single impact. Preferred algorithms are the event duration divided by the number of threshold crossings, the peak amplitude divided by the number of threshold crossings, and the total energy absorbed divided by the number of threshold crossings.

Those signals which through algorithm processing correlate with undesired particles are converted by the analyzer circuit into output signals which actuate a deflecting mechanism to remove the undesired particles from the final rebound trajectory (the third monolayer). Such selection and conversion are readily accomplished by circuitry comprised of a series of common functions readily apparent to one skilled in the art. The actual nature of the circuitry is not critical and can vary widely. The component parts will generally include a decision block for performing the algorithm and discriminating among the waveforms accordingly, a timing mechanism for synchronizing the system and controlling the sampling interval, and a delay circuit for coordinating the ejection mechanism with the particle arrival and location. The result is the generation of an output signal to the ejection mechanism at an appropriate time to deflect the particles from their path.

The ejection system may be any mechanism capable of delivering an impulse to the falling particles, which is focused in a specific region of the falling layer and at an angle sufficient to deflect individual particles for small groups of particles in that region out of the trajectory without substantially affecting the free fall of the other particles. The mechanism will generally include a time delay relating to the particle speeds such that the ejected particle will be the one whose impact generated the actuating signal. The impulse may arise from any force effective to deflect the particles—mechanical, pneumatic, electrical, magnetic or the like. The appropriate choice will depend on the nature and size of the particle and other characteristics of the system.

For food particles, the impulse is preferably supplied by an air blast, with direction focused by ports or nozzles, and timing controlled by electronically actuated valves, notably pneumatic or solenoid-operated. In the embodiment shown in the drawings, pressurized air is retained in a plenum 20 which is fed by a conduit 21 from a pressurized air source. Air is ejected from the plenum through a series of ports 22 leading outward in the radial direction from a point along the common axis of the various cylindrical surfaces of the system. The ports extend around the full circumference of the structure to provide access to all falling particles. Each port or group of adjacent ports is controlled by a valve (not shown) which operates independently of the other valves. Each valve is actuated by an appropriate signal originating from the closest transducer on the second strike plate. Furthermore, in embodiments where a single transducer is present on the first strike plate, an appropriate signal therefrom will actuate all valves simultaneously. In the embodiment shown, several air ports are associated with each transducer to provide a broad enough yet sufficiently focused blast of air to ensure that the offending particle is ejected. For single-valve blasts, each blast will be of sufficient duration and intensity to cause the deflection of substantially one particle.

Figure 2:
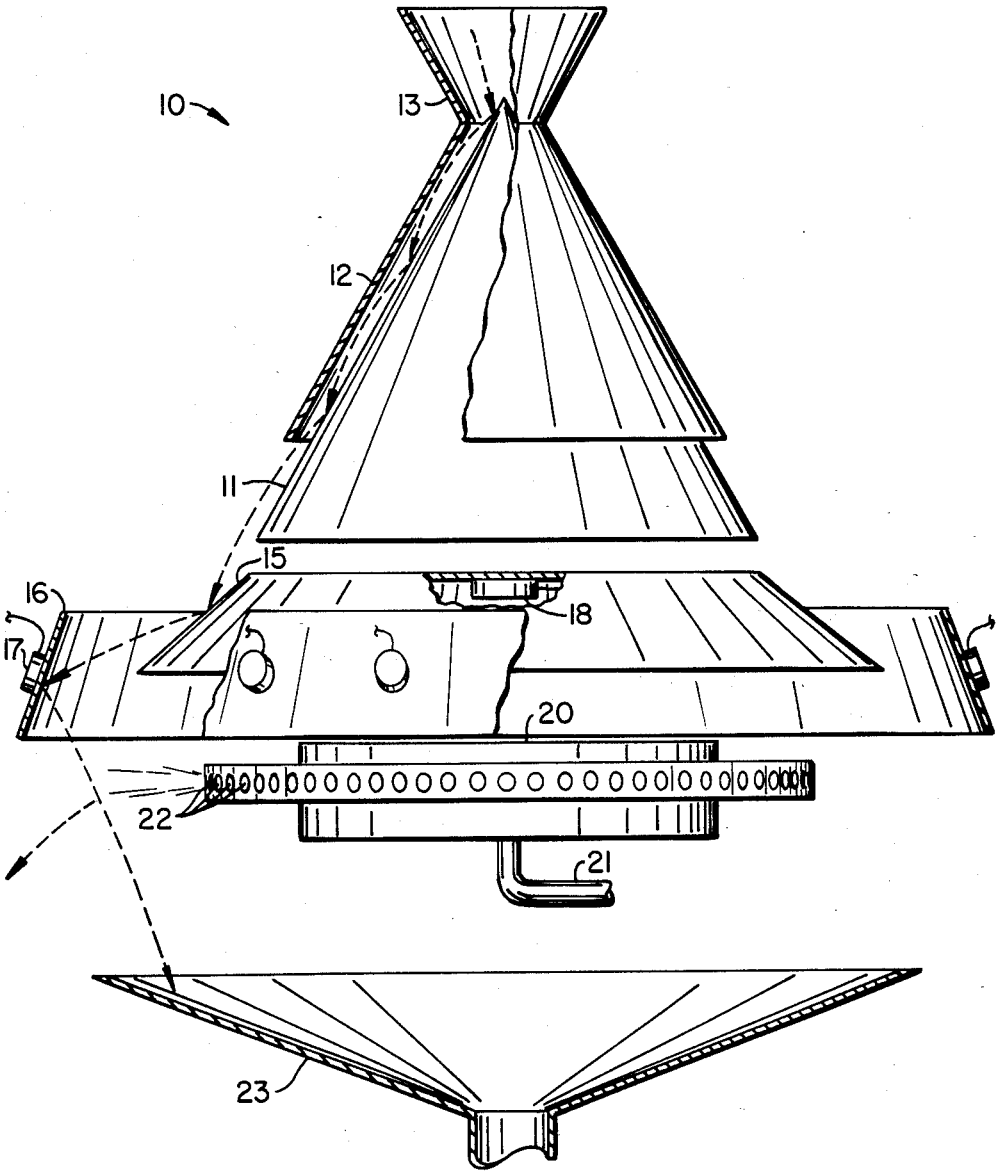
FIG. 2 is a cutaway side elevation of the apparatus of FIG. 1.

As shown in FIG. 2, the air blast will deflect the particle out of the third monolayer trajectory. The undeflected particles are then collected in a hopper 23 which is suitably shaped and positioned to collect substantially all non-deflected particles and substantially none of the deflected ones. As an optional variation, the material falling in the collection hopper 23 may be recycled to the feed hopper 13 to ensure that all offending particles are ultimately removed.

Figure 3:
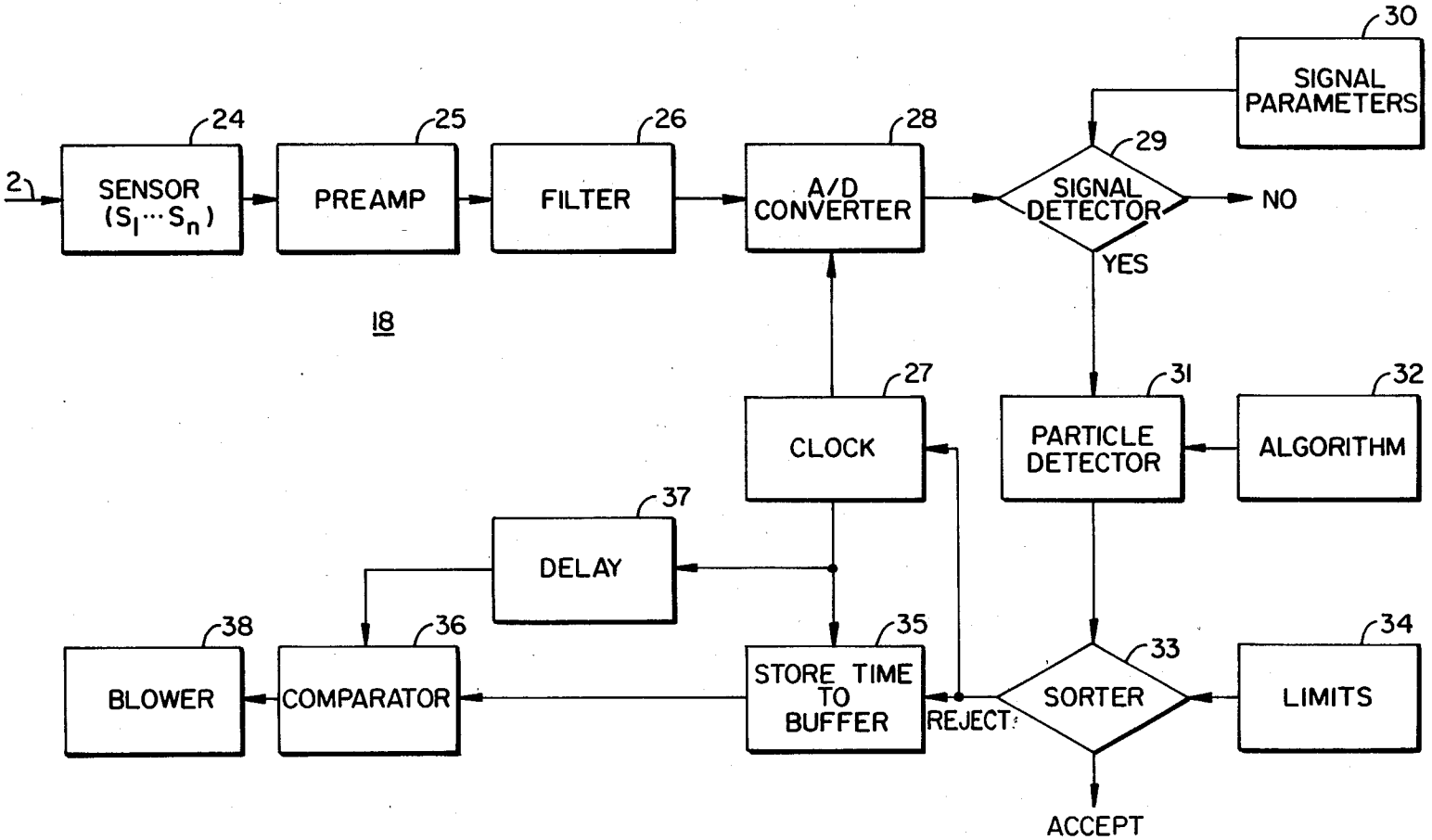
FIG. 3 is a functional block diagram exemplifying an analyzer/controller circuit for a single sensor system.

Turning now to FIG. 3, a functional block diagram representing one example of a basic analyzing and controlling circuit for combining a plurality of waveform features in an algorithm is shown. For simplicity, the circuit shown is one designed for a single sensor 24, which may be a piezoelectric transducer acoustically coupled to the second strike plate as described above. Also for simplicity, neither of the two strike plates is shown. It will be recalled that the only impacts detected by the transducer are those whose kinetic energy results in a signal exceeding a preset voltage threshold, the energy having been reduced by the first strike plate on a preferential basis according to the size and/or composition of the particles.

In the circuit shown, the transducer is tuned for a broad-band frequency response ranging to about 2 MHz. The signal generated by the transducer passes through a preamplifier 25 which increases the size of the signal to a measurable level such as, for example, a range of 10 to 80 dB, then through a filter 26. The latter may be selected to remove unwanted frequency components in the captured waveform for a higher signal-to-noise ratio, to exclude outside interference signals such as low frequency mechanical noise sources below about 100 kHz, or both. A timer 27 synchronizes the remainder of the circuit by performing functions which include controlling the sampling interval and providing a reference for the delay needed to coordinate the ejector.

From an analog-to-digital converter 28, the signal enters a signal detector 29 which is a decision block using bounded (empirical) values of designated signal parameters 30 such as the peak amplitude, ring-down count or event duration to reject false signals. A particle detector 31 in the form of a window permits the passage only of signals arising from actual particle impact on the basis the signal parameters processed according to an algorithm 32. The signals then pass to a sorter 33, which is a decision block accepting or rejecting the processed signals on the basis of preestablished limits 34 according to the particle size and/or composition, differentiating acceptable from unacceptable particle forms. Output signals from the sorter representing unacceptable particles are then passed to a time storage input to a buffer 35 and then to a comparator 36 via a time delay 37. The comparator triggers a blower 38 directed to the final particle trajectory, and the delay insures that the particle to be rejected is in the path of the blower when the blower is triggered.

Figure 4:
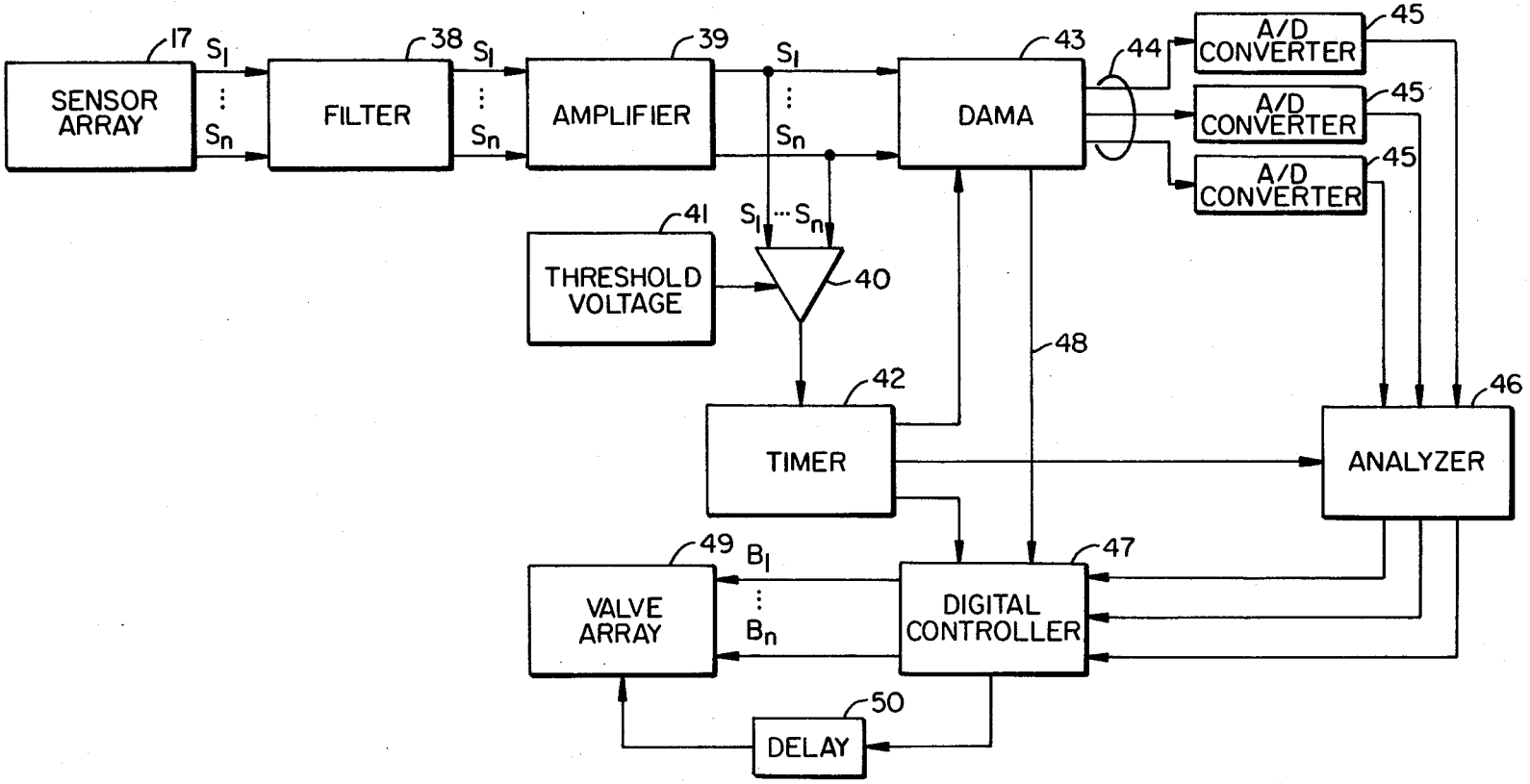
FIG. 4 is a functional block diagram exemplifying an analyzer/controller circuit for use in conjunction with the embodiment shown in FIGS. 1 and 2.

FIG. 4 is a functional block diagram for a circuit designed to accommodate n transducers, such as the transducers 17 of the apparatus shown in FIGS. 1 and 2. Following particle dampening through successive impacts from the first absorber strike plate to the second (recorder) strike plate, signals $S_1$ through $S_n$ emitted by the transducers are individually conditioned by band-pass filters 38 and amplifiers 39. The filter range is selected to encompass the expected range of frequencies arising from actual particle impact while eliminating noise. The amplified signals are fed to a comparator 40 which is supplied with a threshold reference voltage 41. The comparator emits a digital pulse to mark the crossing of the threshold by any one of the amplified signals.

The pulse is supplied to a timer 42 which coordinates the waveform analyzing portion of the circuit (described below) with the source of each signal.

The threshold voltage is selected to cause the comparator to emit a pulse whenever an impact of an accountable particle on the strike plate occurs. The timer directs these pulses to a direct assignment multiple access (DAMA) multiplexer 43 or any analog statistical multiplexer which, when thus actuated, routes the signal which originally generated the pulse to one of a number of channels 44. In the figure, three channels are shown, thus permitting the system to analyze up to three impacts at once. Any number of channels may be used, depending on the maximum number of impacts which are expected to occur at the same time or with indistinguishable response overlap.

The signal passing through each channel is processed by an analog-to-digital converter 45, and the resulting digital signal is supplied to an analyzer 46, i.e., the waveform analyzing portion of the circuit. The latter is any conventional decision block which selects certain signals by known discrimination means on the basis of preset signal parameters corresponding to the differences between desired and undesired particles. As mentioned above, these parameters are preferably processed according to an algorithm which divides either the event duration, peak amplitude or total energy absorbed by the ringdown count. Values of the selected ratio which correspond to particles to be ejected cause the generation of signals by the analyzer which are directed to a digital controller 47 which generates output signals $B_1$ through $B_n$ to correspond to each sensor region. Code information from the multiplexer is also supplied to the digital controller (through line 48), matching the input signals $S_1$ through $S_n$ to output signals $B_1$ through $B_n$. The timer thus coordinates the analyzer response to couple each input signal with an output signal to the appropriate ejection mechanism.

The output signals $B_1$ through $B_n$ are each directed to a separate ejection mechanism for sending an impulse to the particle sought to be ejected. The array of such mechanisms is designated 49. For the type of apparatus shown in FIGS. 1 and 2, a particularly useful form for these mechanisms is a series of solenoid valves on a common plenum 20 of compressed air, as described above, one such valve corresponding to each transducer and aimed to direct a stream of air at particles whose impacts were sensed by the transducer. A delay switch 50 is interposed between the controller and the solenoid valves to ensure that the offending particle is in the path of the resulting air blast when the valve is open.

A similar circuit (without multiplexer) can serve as the waveform analyzing circuit for a single transducer system, such as the transducer 18 on the first strike plate.

The following example is offered for illustrative purposes, and is intended neither to define nor limit the invention in any manner.

EXAMPLE

A quantity of walnuts was chopped into pieces of a maximum size of about 5/16 inch (0.8 cm), and then sorted manually into shell and meat pieces. These groups were fed separately to a strike plate arrangement similar to that shown in FIGS. 1 and 2, with the following design features:

Angle of delivery cone: 60°
Angle of first strike plate: 40°
Angle of second strike plate: 70°
First strike plate material: stainless steel
Second strike plate material: aluminum
Second strike plate transducer response range: 0–2 MHz
Signal bandpass filter range: 600–800 kHz.

The transducer signals were amplified to a range of 80 dB and their waveforms analyzed as follows, using a threshold amplitude of 0.15 volts:

WAVEFORM ANALYSIS AT SECOND STRIKE PLATE

| Peak Amplitude (dB) | Ringdown Count (RDC) | Event Duration (ED) (nanoseconds) | Algorithm (ED)/(RDC) |
|---|---|---|---|
| Shell Impacts: | | | |
| 33 | 8 | 27 | 3.38 |
| 17 | 5 | 24 | 4.80 |
| 22 | 5 | 18 | 3.60 |
| 22 | 6 | 25 | 4.17 |
| 10 | 1 | 1 | 1.00 |
| 12 | 9 | 52 | 5.79 |
| 20 | 5 | 47 | 9.40 |
| 27 | 8 | 27 | 3.38 |
| 26 | 6 | 19 | 3.17 |
| 49 | 9 | 31 | 3.44 |
| Nutmeat Impacts: | | | |
| 10 | 4 | 20 | 2.85 |
| 9 | 2 | 3 | 1.50 |
| 15 | 4 | 7 | 1.75 |
| 10 | 4 | 30 | 7.50 |
| 17 | 7 | 11 | 1.57 |
| 8 | 1 | 1 | 1.00 |
| 13 | 5 | 9 | 1.80 |
| 16 | 13 | 32 | 2.46 |
| 22 | 7 | 10 | 1.43 |
| 10 | 2 | 3 | 1.50 |

The algorithm used in the table is the ratio of event duration to ringdown count. The signals where the ratio value is 1.0 are clearly noise, and are readily rejected on this basis by setting 1.0 as a special (discrete) signal rejection criterion in a particle detector such as that represented by 31 in FIG. 3. Furthermore, it is apparent that by setting the particle rejection criterion (minimum ratio value) at (ED)/(RDC)=3.0 one can distinguish shell pieces from nutmeat pieces to a high degree of accuracy. Only one nutmeat piece (where that ratio was 7.50) would be rejected along with the shells.

It is clear from these data that one can readily identify shell fragments in a mixture of shell and nutmeat particles on the basis of the response of the second strike plate following impact on the first. Tests designed to isolate the shell have demonstrated in a representative product mixture containing about ten accountable shell pieces in 25 pounds of nutmeat product (of a maximum 5/16-inch particle size) that the double strike plate impact by itself reduces false triggering (from acceptable nutmeat pieces) to less than 5% of the total particle count.

Further analyses may be performed using the ratio algorithm illustrated to substantially eliminate product waste due to false triggering. Test runs to identify (detect) the shell fragments in a representative near end line product sample containing a mixture of shell and nutmeat pieces have been performed. In representative product mixtures containing about 10 to 20 shell pieces in 25 pounds of walnut meat, it has been demonstrated that a conditional waveform algorithm such as has been illustrated may be used following an initial screening of the product via the double strike rebound impact to reduce the level of false signals from acceptable (large)

nutmeat particles to less than 1% of the particle throughput.

The foregoing description is offered primarily for purposes of illustration. It will be readily apparent to those skilled in the art that numerous variations and modifications of each of the system aspects described above, as well as alternative components, structural features and modes of operation, can be introduced into the system without departing from the spirit and scope of the invention as defined by the appended claims.

What is claimed is:

1. Apparatus for sorting particles, comprising:

means for propelling said particles along a preselected feed trajectory;

a first surface intersecting said feed trajectory and adapted to rebound all of said particles into a first rebound trajectory while preferentially reducing the kinetic energy in a portion of said particles by preferential absorption of said energy therefrom according to the composition thereof;

a second surface intersecting said first rebound trajectory and capable of rebounding said particles into a second rebound trajectory while absorbing residual kinetic energy therefrom;

means for sensing vibrations in said second surface arising from said absorbed energy and for generating a signal when the value of a distinguishing characteristic of said vibrations falls within a preselected range; and means for converting said signal to an impulse directed toward said second rebound trajectory to deflect therefrom the particle giving rise to said signal.

2. Apparatus according to claim 1 in which said sensing means comprises means for converting said vibrations to an electrical signal; and said distinguishing characteristic is selected from the group consisting of the peak amplitude of said signal, the total energy of said signal, the duration of said signal with respect to a preselected threshold, the number of threshold crossings in said signal, and combinations thereof.

3. Apparatus according to claim 1 in which said sensing means comprises means for converting said vibrations to an electrical signal; and said distinguishing characteristic is selected from the group consisting of the peak amplitude of said signal divided by the number of times a preselected threshold is crossed during said signal, the total energy of said signal divided by the number of times said threshold is crossed, and the duration of said signal with respect to said threshold divided by the number of times said threshold is crossed.

4. Apparatus according to claim 1 in which said sensing means comprises means for converting said vibrations to an electrical signal; and said distinguishing characteristic is the duration of said signal divided by the number of times a preselected threshold is crossed during said signal.

5. Apparatus according to claim 1 in which said impulse is a blast of air directed transverse to said second rebound trajectory, the duration and intensity of said blast being sufficient to deflect substantially one particle from said trajectory.

6. Apparatus according to claim 1 in which said sensing means is responsive to vibrations having frequencies within the range of about 500 kHz upward.

7. Apparatus according to claim 1 in which said sensing means is responsive to vibrations having frequencies within the range of about 600 kHz to about 800 kHz.

8. Apparatus for sorting a mixture of particles, comprising:

means for dispersing said mixture into a free-falling monolayer;

a first surface intersecting said monolayer along a first line of intersection to rebound all of said particles along a second monolayer, said first surface adapted to preferentially reduce the kinetic energy in a portion of said particles by preferential absorption of said energy therefrom according to the composition thereof;

a second surface intersecting said second monolayer along a second line of intersection to rebound said particles along a third monolayer, said second surface being capable of absorbing residual kinetic energy from said particles and vibrating in response thereto, said vibrations being substantially confined to a region surrounding the point of impact;

means for independently sensing said vibrations at a plurality of sensing points along said second line of intersection and sufficiently closely spaced to sense substantially all said vibrations, and for generating an independent signal corresponding to each said sensing point when the value of a distinguishing characteristic of the vibrations sensed at said sensing point falls within a preselected range; and means for converting each said signal to an impulse directed toward said third monolayer to deflect therefrom the particle giving rise to said signal.

9. Apparatus according to claim 8 in which said dispersing means is a sloping surface.

10. Apparatus according to claim 8 in which said sensing means comprises means for converting said vibrations to an electrical signal; and said distinguishing characteristic is selected on the basis of the frequency of said vibrating response.

11. Apparatus according to claim 8 where said distinguishing characteristic of the vibrations sensed at said sensing point is frequency.

12. Apparatus according to claim 8 in which said sensing means comprises means for converting said vibrations to an electrical signal; and said distinguishing characteristic is selected from the group consisting of the peak amplitude of said signal, the total energy of said signal, the duration of said signal with respect to a preselected threshold, the number of threshold crossings in said signal, and combinations thereof.

13. Apparatus according to claim 8 in which said sensing means comprises means for converting said vibrations to an electrical signal; and said distinguishing characteristic is selected from the group consisting of the peak amplitude of said signal divided by the number of times a preselected threshold is crossed during said signal, the total energy of said signal divided by the number of times said threshold is crossed, and the duration of said signal with respect to said threshold divided by the number of times said threshold is crossed.

14. Apparatus according to claim 8 in which said sensing means comprises means for converting said vibrations to an electrical signal; and said distinguishing characteristic is the duration of said signal divided by the number of times a preselected threshold is crossed during said signal.

15. Apparatus according to claim 8 in which said impulse is a blast of air directed transverse to said second rebound trajectory, the duration and intensity of said blast being sufficient to deflect substantially one particle from said trajectory.

16. Apparatus according to claim 8 in which said sensing means is responsive to vibrations having frequencies within the range of about 600 kHz to about 800 kHz; said sensing means includes means for converting said vibrations to an electrical signal; and said distinguishing characteristic is the duration of said signal with respect to a preselected threshold divided by the number of times said preselected threshold is crossed during said signal.

17. Method for sorting a mixture of particles according to composition, comprising:

(a) propelling said particles in a stream toward a first surface adapted to rebound all of said particles and to preferentially reduce the kinetic energy in a portion of the particles in said stream by preferential absorption of said energy therefrom according to the composition thereof, said first surface being oriented to cause said rebounding particles to strike a second surface capable of rebounding said particles, of absorbing residual kinetic energy therefrom, and of vibrating in response to said absorption;

(b) sensing vibrations in said second surface;

(c) generating a signal when the value of a distinguishing characteristic of the waveform of said vibrations falls within a preselected range; and (d) converting said signal to an impulse directed toward the particle stream rebounding from said second surface to deflect from said stream the particle giving rise to said signal.

18. Method according to claim 17 in which step (b) is performed by a piezoelectric device acoustically coupled to said second surface.

19. Method according to claim 17 in which step (b) is performed by a piezoelectric device acoustically coupled to said second surface to convert said vibrations to an electrical signal; and the distinguishing characteristic of step (c) is selected on the basis of the frequency of said vibrating response.

20. Method according to claim 17 in which step (b) is performed by a piezoelectric device acoustically coupled to said second surface to convert said vibrations to an electrical signal; and the distinguishing characteristic of step (c) is selected from the group consisting of the peak amplitude of said signal, the total energy of said signal, the duration of said signal with respect to a preselected threshold, the number of threshold crossings in said signal, and combinations thereof.

21. Method according to claim 17 in which step (b) is performed by a piezoelectric device acoustically coupled to said second surface to convert said vibrations to an electrical signal; and the distinguishing vibrations characteristic of step (c) is selected from the group consisting of the peak amplitude of said signal divided by the number of times a preselected threshold is crossed during said signal, the total energy of said signal divided by the number of times said threshold is crossed, and the duration of said signal with respect to said threshold divided by the number of times said threshold is crossed.

22. Method according to claim 17 in which step (b) is performed by a piezoelectric device acoustically coupled to said second surface to convert said vibrations to an electrical signal; and the distinguishing characteristic of step (c) is the duration of said signal with respect to a preselected threshold divided by the number of times said threshold is crossed during said signal.

23. Method according to claim 17 in which the impulse of step (d) is a blast of air directed transverse to said rebounding particle stream, the duration and intensity of said blast being sufficient to deflect substantially one particle from said stream.

24. Method according to claim 17 in which step (b) is restricted to vibrations having frequencies within the range of about 500 kHz upward.

25. Method according to claim 17 in which step (b) is restricted to vibrations having frequencies within the range of about 600 kHz to about 800 kHz.

26. Method for sorting a mixture of particles according to composition, comprising:

(a) dispersing said mixture into a first free-falling monolayer;

diverting said first monolayer into a second monolayer by rebounding all of the particles therein off a first surface, said first surface reducing the kinetic energy in a portion of the particles in said first monolayer on a preferential basis by absorption of said energy according to the composition of said particles;

(c) diverting said second monolayer into a third monolayer by rebounding the particles therein off a second surface, said second surface absorbing residual kinetic energy from said particles and vibrating in response to said absorption, the vibrations arising from each particle impact being substantially confined to a region surrounding the point of impact;

(d) independently sensing said vibrations at a plurality of sensing points on said second surface sufficiently closely spaced to sense substantially all vibrations;

(e) generating an independent signal corresponding to each said sensing point when the value of a distinguishing characteristic of the vibrations there sensed falls within a preselected range; and (f) converting each signal to an impulse directed toward said third monolayer to deflect therefrom the particle giving rise to said signal.

27. Method according to claim 26 in which step (d) is performed by piezoelectric devices acoustically coupled to said second surface, one at each of said sensing points.

28. Method according to claim 26 in which step (d) is performed by piezoelectric devices acoustically coupled to said second surface, one at each of said sensing points, to convert said vibrations to an electrical signal; and the distinguishing characteristic of step (e) is selected from the group consisting of the peak amplitude of said signal, the total energy of said signal, the duration of said signal with respect to a preselected threshold, the number of threshold crossings in said signal, and combinations thereof.

29. Method according to claim 26 in which step (d) is performed by piezoelectric devices acoustically coupled to said second surface, one at each of said sensing points, to convert said vibrations to an electrical signal; and the distinguishing characteristic of step (e) is selected from the group consisting of the peak amplitude of said signal divided by the number of times a preselected threshold is crossed during said signal, the total energy of said signal divided by the number of times said threshold is crossed, and the duration of said signal with respect to said threshold divided by the number of times said threshold is crossed.

30. Method according to claim 26 in which step (d) is performed by piezoelectric devices acoustically coupled to said second surface, one at each of said sensing points, to convert said vibrations to an electrical signal; and the distinguishing characteristic of step (e) is the duration of said signal with respect to a preselected threshold divided by the number of times said threshold is crossed during said signal.

31. Method according to claim 26 in which the impulse of step (f) is a blast of air directed transverse to said rebounding particle stream, the duration and intensity of said blast being sufficient to deflect substantially one particle from said stream.

32. Method according to claim 26 in which step (d) is restricted to vibrations having frequencies within the range of about 600 kHz to about 800 kHz; and the distinguishing characteristic of step (e) is the duration of said signal with respect to a preselected threshold divided by the number of times said preselected threshold is crossed during said signal.

33. Apparatus for sorting a mixture of particles, comprising:

a circular cone with vertical axis and expanding downward, and adpated to disperse said mixture into a free-falling monolayer;

a first surface intersecting said monolayer along a first line of intersection to rebound all of said particles along a second monolayer, said first surface being capable of preferentially absorbing kinetic energy from a portion of said particles according to the composition thereof;

a second surface intersecting said second monolayer along a second line of intersection to rebound said particles along a third monolayer, said second surface being capable of absorbing residual kinetic energy from said particles and vibrating in response thereto, said vibrations being substantially confined to a region surrounding the point of impact;

means for independently sensing said vibrations at a plurality of sensing points along said second line of intersection and sufficiently closely spaced to sense substantially all said vibrations, and for generating an independent signal corresponding to each said sensing point when the value of a distinguishing characteristic of the vibrations sensed at said sensing points falls within a preselected range; and means for converting each said signal to an impulse directed toward said third monolayer to deflect therefrom the particle giving rise to said signal.

34. Apparatus according to claim 33 further comprising a vertical conical shell of the same angle as said circular cone, surrounding said circular cone and coaxial therewith.

35. Apparatus according to claim 34 in which said cone and said conical shell are separated by a gap of width ranging from about 1.5 to about 10 times the major dimension of the largest particle in said mixture.

36. Apparatus according to claim 34 in which said cone and said conical shell are separated by a gap of width ranging from about 2 to about 5 times the major dimension of the largest particle in said mixture.

37. Apparatus according to claim 34 in which the angle of said cone and said conical shell is from about 45° to about 75° with respect to the horizontal, said cone and said conical shell are separated by a gap of width ranging from about 2 to about 5 times the major dimension of the largest particle in said mixture, and the length of the surface of said cone is from about 5 to about 50 times the width of said gap.

38. Apparatus according to claim 33 in which the angle of said cone is from about 30° to about 80° with respect to the horizontal.

39. Apparatus according to claim 33 further comprising a vertical conical shell of the same angle as said circular cone, surrounding said circular cone and coaxial therewith, and in which said first surface is a transverse conical section coaxial with and beneath said circular cone, the angle of which, with respect to the horizontal, is less than that of said circular cone.

40. Apparatus according to claim 39 in which the angle of said transverse conical section is from about 30° to about 50° with respect to the horizontal.

41. Apparatus according to claim 33 further comprising a vertical conical shell of the same angle as said circular cone, surrounding said circular cone and coaxial therewith; and in which said first surface is a first transverse conical section coaxial with and beneath said circular cone, the angle of which, with respect to the horizontal, is less than that of said circular cone; and said second surface is the inner surface of a second transverse conical section coaxial with said circular cone and encircling said first transverse conical section.

42. Apparatus according to claim 41 in which the angle of said second transverse concial section, with respect to the horizontal, is greater than that of said first conical section.

43. Apparatus according to claim 42 in which the angle of said second transverse conical section is from about 60° to about 80° witPh respect to the horizontal.

44. Apparatus according to claim 43 in which said sensing means are comprised of piezoelectric transducers, one acoustically coupled to the back of said second surface at each of said sensing points.

45. Method for sorting a mixture of particles according to compositions, comprising:

(a) releasing said mixture under the influence of gravity over a vertical circular cone expanding downward to disperse said mixture into a first monolayer which is cone-shaped and free-falling;

(b) diverting said first monolayer into a second monolayer by rebounding all of the particles therein off a first surface, said first surface reducing kinetic energy in a portion of the particles in said first monolayer on a preferential basis by absorption of said kinetic energy according to the composition of said particles;

(c) diverting said second monolayer into a third monolayer by rebounding the particles therein off a second surface, said second surface absorbing residual kinetic energy from said particles and vibrating in response to said absorption, the vibrations arising from each particle impact being substantially confined to a region surrounding the point of impact;

(d) independently sensing said vibrations at a plurality of sensing points on said second surface sufficiently closely spaced to sense substantially all vibrations;

(e) generating an independent signal corresponding to each said sensing point when the value of a distinguishing characteristic of the vibrations there sensed falls within a preselected range; and (f) converting each said signal to an impulse directed toward said third monolayer to deflect therefrom the particle giving rise to said signal.

46. Method for sorting a mixture of particles according to composition, comprising:

(a) releasing said mixture under the influence of gravity into the space between a vertical circular cone and a conical shell of the same angle, surrounding said cone and coaxial therewith to disperse said mixture into a first monolayer which is conically shaped and free-falling;

(b) diverting said first monolayer into a second monolayer by rebounding all of the particles therein off a first surface, said first surface absorbing kinetic energy from a portion of the particles in said first monolayer on a preferential basis according to composition;

(c) diverting said second monolayer into a third monolayer by rebounding the particles therein off a second surface, said second surface absorbing residual kinetic energy from said particles and vibrating in response to said absorption, vibrations arising from each particle impact being substantially confined to a region surrounding the point of impact;

(d) independently sensing said vibrations at a plurality of sensing points on said second surface sufficiently closely spaced to sense substantially all vibrations;

(e) generating an independent signal corresponding to each said sensing point when the value of a distinguishing characteristic of the vibrations there sensed falls within a preselected range; and (f) converting each said signal to an impulse directed toward said third monolayer to deflect therefrom the particle giving rise to said signal.

* * * * *